US009192838B2

(12) United States Patent
Bazarko

(10) Patent No.: US 9,192,838 B2
(45) Date of Patent: Nov. 24, 2015

(54) TOY GAME APPARATUS AND METHOD OF PLAYING

(71) Applicant: Jeffrey W. Bazarko, Hawthorne, CA (US)

(72) Inventor: Jeffrey W. Bazarko, Hawthorne, CA (US)

(73) Assignee: MATTEL, INC., El Segundo, CA (US)

( * ) Notice: Subject to any disclaimer, the term of this patent is extended or adjusted under 35 U.S.C. 154(b) by 67 days.

(21) Appl. No.: 13/760,623

(22) Filed: Feb. 6, 2013

(65) Prior Publication Data

US 2013/0207346 A1 Aug. 15, 2013

Related U.S. Application Data

(60) Provisional application No. 61/596,976, filed on Feb. 9, 2012.

(51) Int. Cl.

| | |
|---|---|
| ***A63B 67/06*** | (2006.01) |
| ***A63B 63/04*** | (2006.01) |
| ***A63F 1/04*** | (2006.01) |
| ***A63F 7/02*** | (2006.01) |
| ***A63F 7/24*** | (2006.01) |
| ***A63F 7/30*** | (2006.01) |
| ***A63F 7/36*** | (2006.01) |

(52) U.S. Cl.

CPC . *A63B 67/06* (2013.01); *A63F 1/04* (2013.01); *A63F 7/02* (2013.01); *A63F 7/2472* (2013.01); *A63F 7/2481* (2013.01); *A63F 7/305* (2013.01); *A63F 7/3622* (2013.01); *A63F 7/306* (2013.01); *A63F 2007/3637* (2013.01)

(58) Field of Classification Search

USPC ..... 273/110, 113, 118 R, 127 R, 351, 354, 273/355, 357, 378, 380, 405

See application file for complete search history.

(56) References Cited

U.S. PATENT DOCUMENTS

| | | | |
|---|---|---|---|
| 503,022 | A | 8/1893 | Whitburn |
| 1,983,044 | A | 12/1934 | Maynard |
| 2,018,833 | A | 10/1935 | Cahill |

(Continued)

FOREIGN PATENT DOCUMENTS

| | | | |
|---|---|---|---|
| CN | 2403463 | Y | 11/2000 |
| CN | 101443086 | A | 5/2009 |
| CN | 101474484 | A | 7/2009 |

OTHER PUBLICATIONS

Chinese Office Action dated Nov. 4, 2014 for Chinese Patent Application No. 2013/0049202.0, which claims priority to U.S. Appl. No. 13/760,623.

(Continued)

*Primary Examiner* — Nini Legesse

(74) *Attorney, Agent, or Firm* — Cantor Colburn LLP

(57) ABSTRACT

A ramp for launching an object at a target is provided, the ramp having: a release mechanism mounted to the ramp for movement between a first position and a second position, wherein the release mechanism is configured to retain the object with respect to the ramp when it is in the first position and wherein the release mechanism is configured to release the object when the release mechanism is in the second position; and wherein the release mechanism further comprises an arm member pivotally mounted to the ramp and the arm member has a plurality of features each spaced from each other and extending from the arm member above a surface of the ramp when the release mechanism is in the first position.

20 Claims, 9 Drawing Sheets

(56) References Cited

U.S. PATENT DOCUMENTS

| | | | | |
|---|---|---|---|---|
| 2,463,909 | A | 3/1949 | Ruch | |
| 3,132,864 | A * | 5/1964 | Glass et al. | 273/127 R |
| 3,195,267 | A | 7/1965 | Gehlen | |
| 3,480,210 | A | 11/1969 | Perrinjaquet | |
| 3,502,332 | A | 3/1970 | Wolf | |
| 3,542,366 | A | 11/1970 | Schocker | |
| 3,582,075 | A * | 6/1971 | Glass et al. | 273/317 |
| 3,697,075 | A | 10/1972 | Nania | |
| 3,735,923 | A | 5/1973 | Brigham et al. | |
| 3,767,200 | A | 10/1973 | Lohr | |
| 3,777,412 | A | 12/1973 | Lawlor et al. | |
| 3,794,325 | A * | 2/1974 | Stender | 273/399 |
| 3,807,738 | A | 4/1974 | Breslow | |
| 3,884,469 | A | 5/1975 | Morton | |
| 3,905,350 | A | 9/1975 | Becker | |
| 3,973,774 | A * | 8/1976 | Breslow et al. | 124/79 |
| 3,980,302 | A | 9/1976 | Meyer | |
| 4,052,067 | A | 10/1977 | Carmo | |
| 4,111,179 | A * | 9/1978 | Hashimoto | 124/7 |
| 4,213,612 | A | 7/1980 | Wildman et al. | |
| 4,260,156 | A | 4/1981 | Momura | |
| 4,343,470 | A | 8/1982 | Grifhorst | |
| 4,509,760 | A * | 4/1985 | Goldfarb et al. | 273/380 |
| 4,534,745 | A | 8/1985 | Jones et al. | |
| 4,575,350 | A | 3/1986 | Hippely et al. | |
| 4,826,176 | A * | 5/1989 | Kobayashi | 273/354 |
| 4,883,273 | A * | 11/1989 | Kobayashi | 273/110 |
| 5,135,221 | A | 8/1992 | Barlow | |
| 5,358,237 | A | 10/1994 | Yu | |
| 6,358,112 | B1 | 3/2002 | Lambert et al. | |
| 6,647,893 | B1 | 11/2003 | Fugitt et al. | |
| 6,913,508 | B2 | 7/2005 | Hornsby et al. | |
| 7,241,223 | B1 | 7/2007 | Caudill | |
| 7,241,233 | B2 | 7/2007 | Sato et al. | |
| 7,285,035 | B1 | 10/2007 | Tullis | |
| 7,455,566 | B2 | 11/2008 | Nelson et al. | |
| 7,614,931 | B2 | 11/2009 | Nuttall | |
| 7,628,673 | B2 | 12/2009 | Bedford et al. | |
| 7,628,674 | B2 | 12/2009 | Nuttall et al. | |
| 7,651,398 | B2 | 1/2010 | Ostendorff et al. | |
| 7,770,811 | B2 | 8/2010 | Belding | |
| 7,794,301 | B2 | 9/2010 | Ostendorff et al. | |
| 7,845,640 | B2 | 12/2010 | Motegi et al. | |
| 7,857,679 | B2 | 12/2010 | O'Connor et al. | |
| 7,892,068 | B2 | 2/2011 | Nuttall et al. | |
| 8,011,994 | B2 | 9/2011 | Fink et al. | |
| 8,016,639 | B2 | 9/2011 | Jobe | |
| 8,057,276 | B2 | 11/2011 | O'Connor et al. | |
| 2009/0224473 | A1 | 9/2009 | Motegi et al. | |
| 2010/0041305 | A1 | 2/2010 | O'Connor et al. | |
| 2010/0330868 | A1 | 12/2010 | Payne | |
| 2011/0021110 | A1 | 1/2011 | Hippely et al. | |

OTHER PUBLICATIONS

English Translation of CN101474484 Abstract.
English Translation of CN2403463 Abstract.
English Translation of CN101443086 Abstract.

* cited by examiner

TOY GAME APPARATUS AND METHOD OF PLAYING

CROSS REFERENCE TO RELATED APPLICATIONS

This application claims the benefit of U.S. Provisional Patent Application No. 61/596,976 filed Feb. 9, 2012, the contents of which are incorporated herein by reference thereto.

BACKGROUND

Various embodiments of the present invention relate to a toy game and more particularly, a toy game that provides an element of excitement to the game. Board games, in particular, provide such entertainment. However, if the board game does not provide an added level of uncertainty, anticipation, or surprise the game itself may become mundane with repeated use. Accordingly, it is desirable to provide a game that provides an added level of uncertainty and interaction between the players as well as requiring some skill.

SUMMARY OF THE INVENTION

In one embodiment, a ramp for launching an object at a target is provided, the ramp having: a release mechanism mounted to the ramp for movement between a first position and a second position, wherein the release mechanism is configured to retain the object with respect to the ramp when it is in the first position and wherein the release mechanism is configured to release the object when the release mechanism is in the second position; and wherein the release mechanism further comprises an arm member pivotally mounted to the ramp and the arm member has a plurality of features each spaced from each other and extending from the arm member above a surface of the ramp when the release mechanism is in the first position.

In another embodiment, a ramp and a target is provided, the ramp being configured to launch an object at the target, and the ramp having: a release mechanism that is movably mounted to the ramp for movement between a first position and a second position, wherein the release mechanism is configured to retain the object with respect to the ramp when it is in the first position and wherein the release mechanism is configured to release the object when the release mechanism is in the second position; and wherein the target has a first member pivotally mounted to a second member for movement between a first target position wherein the first member is further away from the second member and a second target position wherein the first member is closer to the second member, and a target release mechanism configured to retain the first member in the first target position by engaging a portion of the first member and wherein the target release mechanism is configured to release the first member and allow it to travel towards the second target position from the first target position when the target release mechanism of the target has been actuated by the object released from the ramp.

In still yet another embodiment, a method of playing a game is provided, the method having the steps of: releasably securing an object to a ramp via a release mechanism that is movably mounted to the ramp for movement between a first position and a second position, wherein the release mechanism is configured to retain the object with respect to the ramp when it is in the first position and wherein the release mechanism is configured to releasable the object when the release mechanism is in the second position; launching the object at a target by moving the releasable mechanism of the ramp to the second position; awarding a player a score if the player launches the object into a cavity of a target such that a first member pivotally mounted to a second member of the target moves from a first target position wherein the first member is further away from the second member to second target position wherein the first member is closer to the second member; and determining a winner of the game by determining which player after a predetermined amount of turns has accumulated the greatest score.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1A:
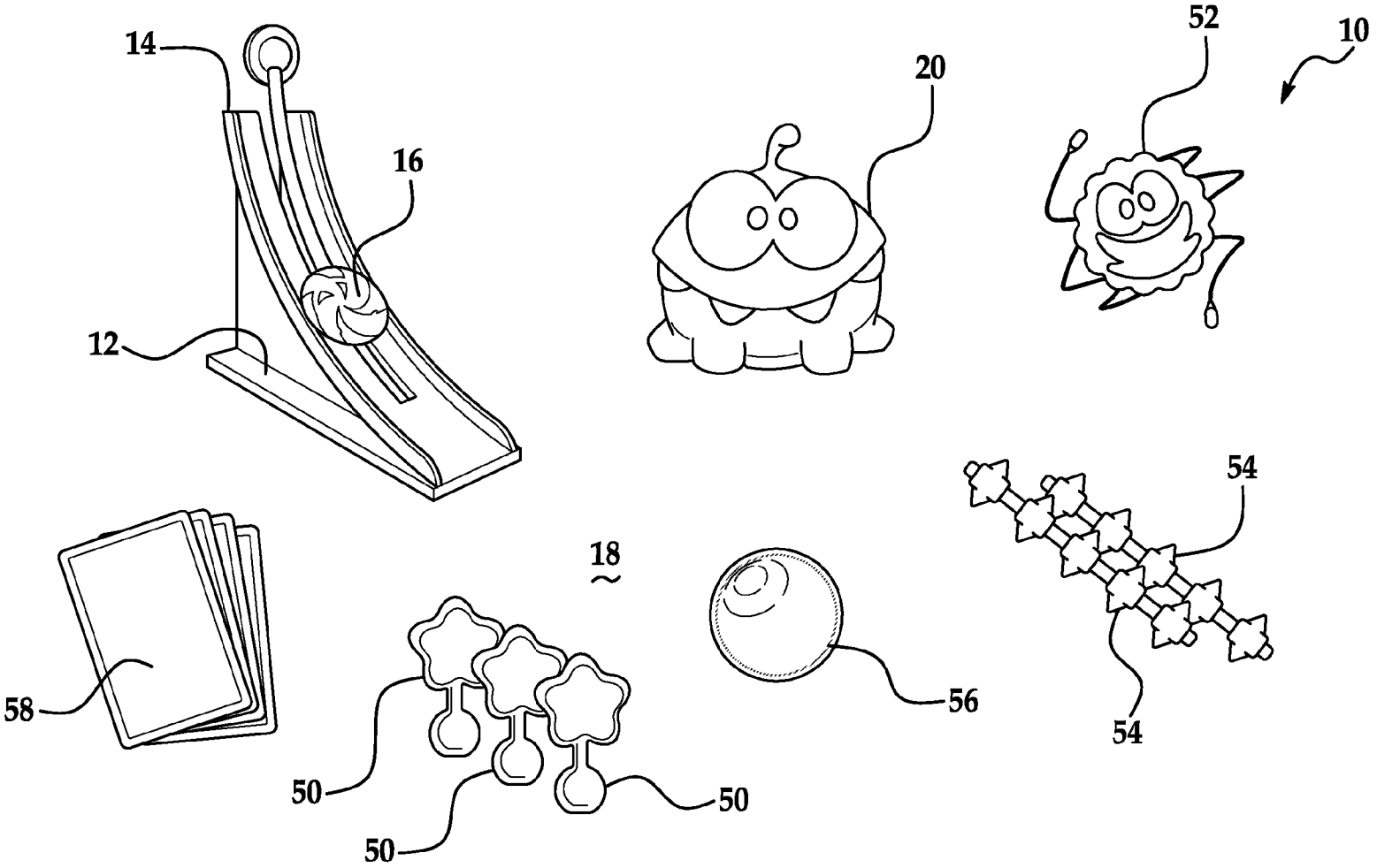
FIGS. 1A-1B are perspective views of a game in accordance with an embodiment.

Although the drawings represent varied embodiments and features of the present invention, the drawings are not necessarily to scale and certain features may be exaggerated in order to illustrate and explain exemplary embodiments of the present invention. The exemplification set forth herein illustrates several aspects of the invention, in one form, and such exemplification is not to be construed as limiting the scope of the invention in any manner.

DETAILED DESCRIPTION

Referring now to the FIGS., various exemplary embodiments of a game 10 are illustrated. In one embodiment, the game 10 includes a ramp 12 with a release mechanism 14 that is configured to releasably retain an object 16 at various levels on the ramp such that the object may be released and slid across a surface 18 at various lengths. For example, when the object 16 is retained at the highest most point of the ramp 12, the object 16 will slide the furthest distance along the surface 18 when released from the ramp 12. Alternatively, and when the object 16 is retained at a lower position on the ramp 12, the object 16 will not slide as far along the surface 18 when released from the ramp 12 as opposed to when it is released from the highest most point.

The game 10 further comprises an object or target 20 that a player of the game attempts to have object 16 received therein when the object 16 is released from the ramp 12 and slid across surface 18. In one embodiment, the object or target 20 has a cavity 22 configured to receive the object therein. Alternatively and in another embodiment, it may be desirable to merely hit target 20 with object 16 when it is released from ramp 12.

Accordingly and based upon the distance of the ramp 12 from the target 20, a user will position the object 16 at an appropriate level along the ramp 12 in an attempt to have the object 16 travel the necessary distance to make contact with the target 20 or be received therein. In order to allow for this variable positioning of the object 16 upon a surface of the ramp 12, the release mechanism 14 is configured to move from a first position wherein the object 16 is retained upon the ramp 12 to a second position wherein the object 16 is no longer retained upon the ramp 12 and thus is free to slide down the ramp 12 due to gravity forces.

Figure 2B:
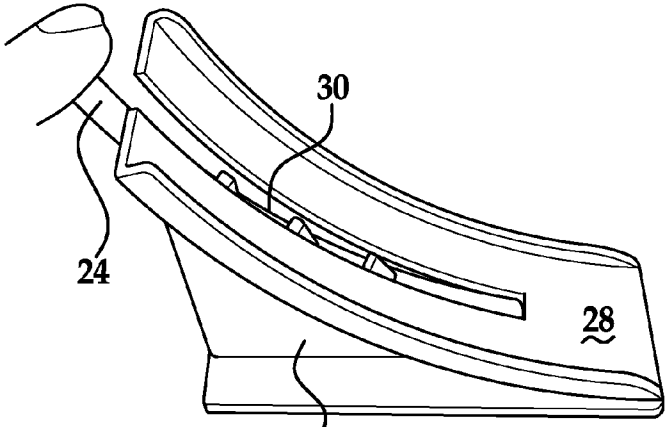
FIGS. 2A-2C are views illustrating a first component of the game.
Figure 2C:
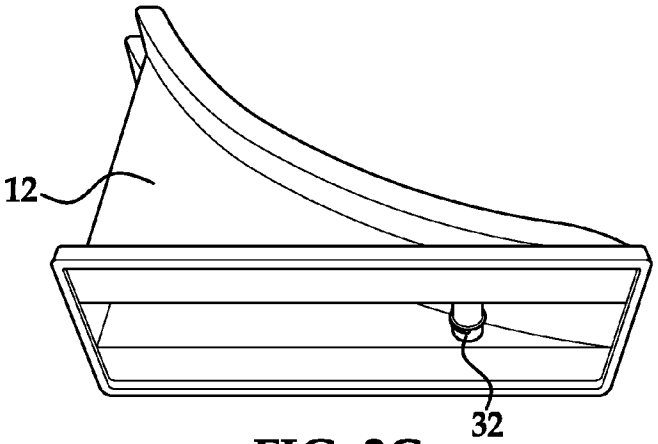
Figure 2A:
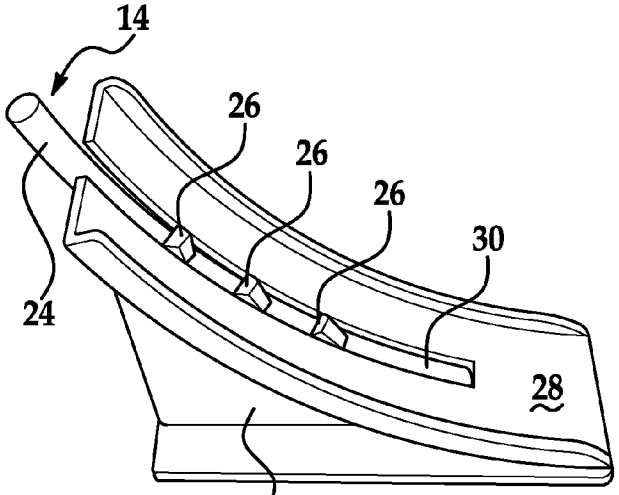
Figure 3:
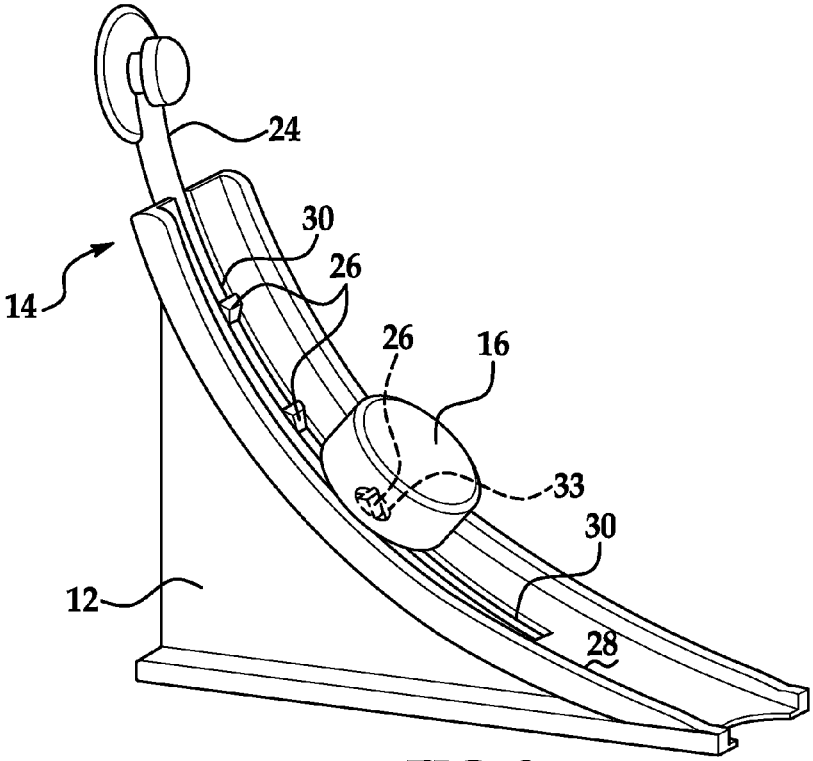
FIG. 3 is a perspective view of the first component of the game.
Figure 3A:
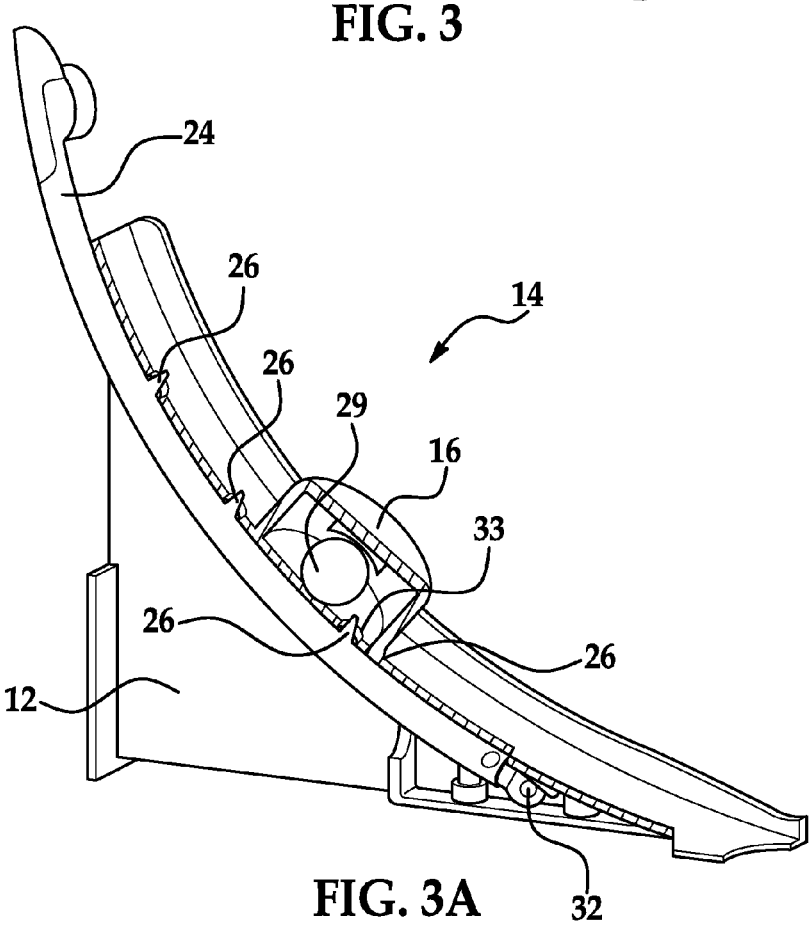
FIG. 3A is a cross-sectional view of the component of FIG. 3.
Figure 4A:
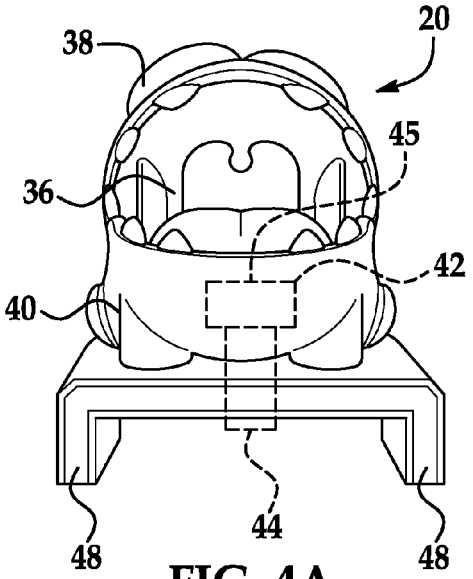
FIGS. 4A-6B are views illustrating movement of a second component of the game.
Figure 4B:
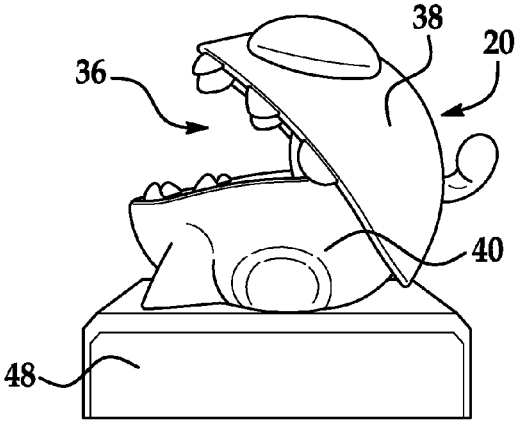
Figure 5A:
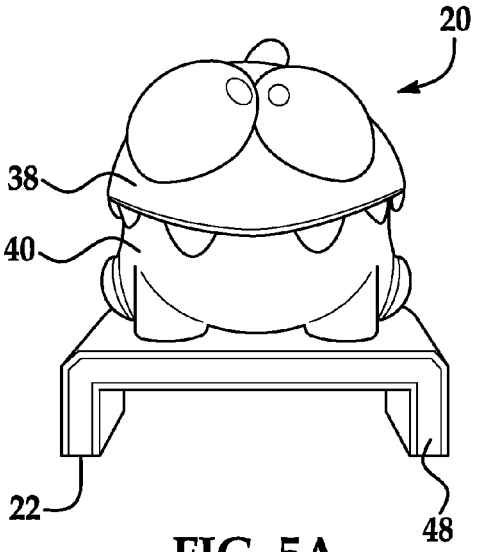
Figure 5B:
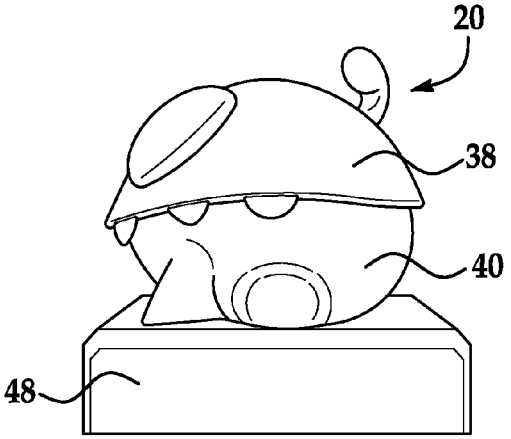
Figure 6A:
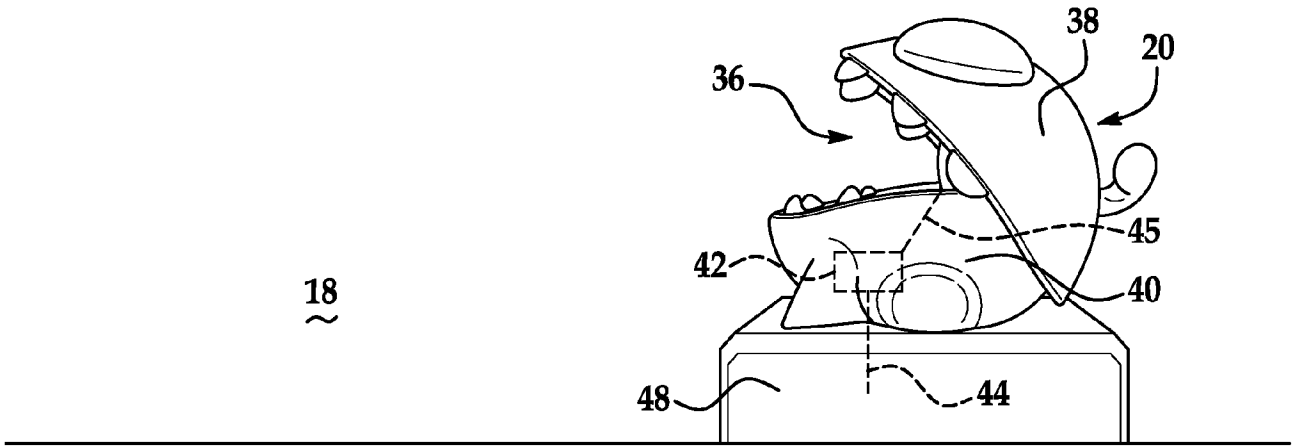
Figure 6B:
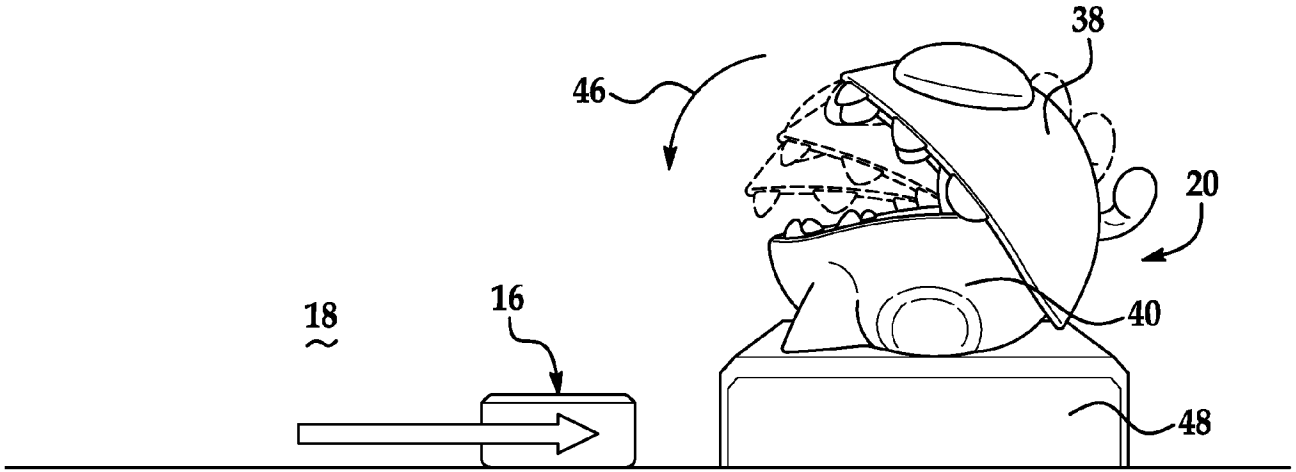
Figure 7A:
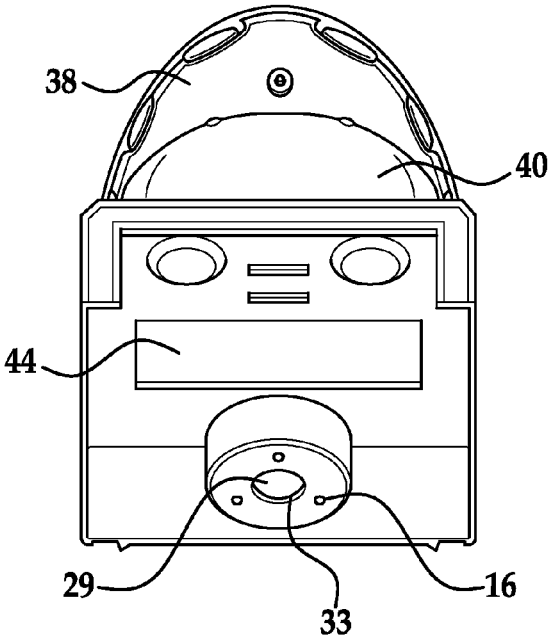
FIGS. 7A-7C are various views illustrating portions of the second component of the game.
Figure 7B:
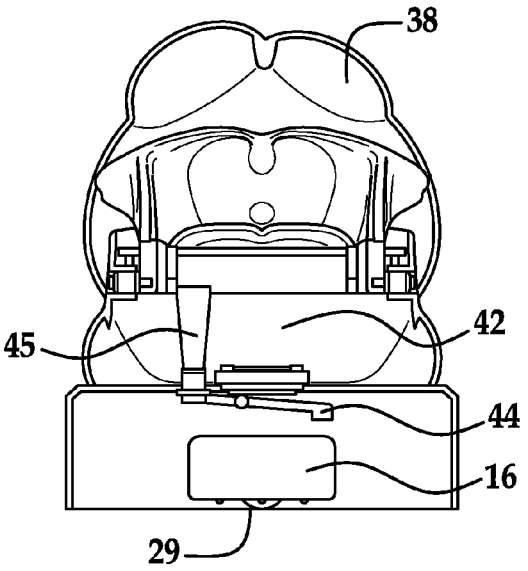
Figure 7C:
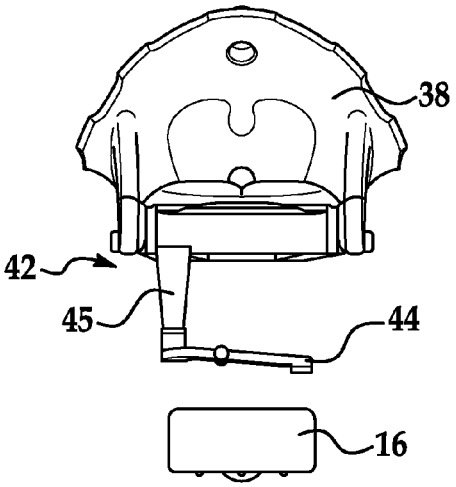

In one non-limiting embodiment and as illustrated at least in FIGS. 2A-3C, the release mechanism 14 comprises an arm member 24 pivotally mounted to the ramp 12 for movement between a first position (FIG. 2A) and a second position (FIG. 2B). When the arm member 24 is in the first position a plurality of features 26 will protrude from a surface 28 of the ramp 12. As illustrated in the attached FIGS., features 26 are positioned along arm member 24 in a spaced fashion such that different levels or heights of securement of the object 16 with respect to the ramp 12 may be provided.

In one embodiment and in order to facilitate the movement of the arm member 24 from the first position to the second position, a portion of the arm member 24 including features 26 is movably received within a slot 30 of the ramp 12. In addition and in one embodiment, the arm member 24 is spring biased into the first position by a spring 32. Accordingly, the arm member 24 is spring biased into the first position such that features 26 protrude from surface 28 of the ramp 12 when the release mechanism is in the first position. In this position the object 16 can be releasably retained on the ramp 12 through engagement of one of the features 26 by a complementary opening 33 located on a lower surface of the object 16. Accordingly, the object 16 may be releasably retained upon the ramp at varying heights depending upon which feature 26 is engaged by opening 33 of the object 16, or additionally and/or alternatively, depending upon where on the object 16 the feature 26 engages.

Thereafter, a user may release object 16 from the ramp 12 by pivoting arm member 24 from the first position to the second position such that the arm member 24 and features 26 become recessed within slot 30 of ramp 12 and thus object 16 is free to slide down along the inclined surface 28 of the ramp 12. In one non-limiting embodiment and in order to facilitate the slidable movement of the object 16 along surface 28 of the ramp 12, a ball bearing 29 may be rotationally received within a cavity of the object such that the ball bearing 29 makes contact with the inclined surface 28 of the ramp 12 as well as surface 18 such that frictional forces are reduced and gravity forces allow the object to be released from the ramp 12 and slide along surface 18 towards target 20.

In conjunction with the ramp 12 and its associated release mechanism 14, the game 10 will further comprise a target or character 20 at which object 16 is directed. In one embodiment and as illustrated in at least FIGS. 4A-7C, the target 20 is configured to resemble a creature capable of movement between a first position or first target position wherein a mouth 36 of the creature 20 is opened and a second position or second target position wherein the mouth 36 of the creature is closed. In one embodiment, the creature 20 has an upper portion 38 pivotally secured to a lower portion 40 such that the aforementioned movement between the first position and the second position is possible.

In one implementation, the creature 20 has a release mechanism or target release mechanism 42 for retaining the mouth or opening 36 in the open position and the release mechanism 42 has a contact member or linkage 44 that is located within cavity 22 of the creature 20. Contact member or linkage 44 is pivotally mounted to the target 20 and is operably coupled to a second linkage member 45 that contacts the upper portion. In one embodiment, the contact member or linkage 44 is configured to be hit or actuated by object 16 when it is received within cavity 22. Accordingly, the release mechanism 42 retains the upper portion 38 in an elevated position with respect to the lower portion 40 such that the creature 20 is in the first position wherein the mouth 36 of the creature 20 is open. Thereafter if the object 16 contacts member or linkage 44, the release mechanism 42 releases upper portion 38 by moving linkage member 45 and allows the same to move in the direction of arrow 46. As a result, the creature 20 transitions from the first position to the second position and thus closes its mouth 36. The release mechanism 42 may additionally serve as an indication mechanism. The indication mechanism may indicate the successful completion of a desired step, such as the successful release of the upper portion 38 by the object 16 contacting member or linkage 44.

In one non-limiting embodiment, when the upper portion 38 is spring biased into the second position and when the release mechanism 42 is actuated, the biasing force of the spring is allowed to move the upper portion 38 in the direction of arrow 46. Alternatively, the upper portion 38 may be prone to movement towards the second position merely due to gravity forces being applied to the upper portion 38. In this configuration, actuation of the release mechanism 42 will allow upper portion 38 to move in the direction of arrow 46 and thus close the mouth 36 of the creature 20.

In one embodiment and in order to provide cavity 22 with linkage 44 located for contact with object 16, a base portion 48 is provided. Base portion 48 is configured such that the creature 20 can be positioned in an elevated configuration with respect to surface 18.

Accordingly, ramp 12 and release mechanism 14 provide a means for a user to releasably retain an object 16 in a manner such that it may be released and slid along surface 28 of the ramp such that it will travel on surface 18 and ultimately towards the intended target 20 which will transition from a first open position to a second closed position upon receipt of the object within cavity 22 through actuation of release mechanism 42.

As such and in one non-limiting embodiment of the present invention, the object of the game 10 is to launch object 16 towards target 20. When actuated by contact with object 16 and during gameplay the release mechanism 42 causes the mouth 36 of the target 20 to close.

In order to provide enhanced gameplay the game 10 further comprises a plurality of items 50 (such as stars for example) that are in one non-limiting embodiment aligned between the end of the ramp 12 and the cavity 22 of object 20. In one implementation and/or method of gameplay the stars 50 are located between the ramp and the object 20 such that they will be contacted and knocked over by object 16 as it travels from ramp 12 towards target/object 20.

In one implementation, each player tries to accumulate as many items or stars 50 as possible and the first player to collect a predetermined amount of stars or the player with the greater amount of stars 50 after a predetermined amount of turns, wins the game.

In one embodiment and in order to accumulate items or stars 50 the same must be knocked down by object 16 as it travels from ramp 12 towards target or creature 20. Before the stars 50 may be tallied or scored, the object must enter into cavity 22 and actuate release mechanism 42 such that the target or creature 20 transitions from the first position to the second position giving the visual effect that it has eaten the object 16. In one non-limiting embodiment, object 16 is configured to resemble candy or other edible item such that when it is received within cavity 22 the creature 20 appears to be or provides the suggestion of eating the object 16. Accordingly and in order to accumulate the items or stars 50 a player must first knock stars 50 down with object 16 as it travels from ramp 12 towards creature 20 and then object 16 must be received within cavity 22 and actuate release mechanism 42.

Numerous variations are possible. For example players may have a predetermined amount of turns for launching the object 16 from the ramp 12. The player then tallies or scores all of the knocked down stars as long as the release mechanism 42 of the creature 20 is actuated before that player's predetermined amount of turns expire. Alternatively, a player may only tally or score the knocked down stars 50 as long as the object 16 is received within the creature 20 and the release mechanism 42 is actuated. In other words, the object 16 must transition from the ramp 12 to the creature 20 and knockdown at least one star 50 in order for that player to retain the star 50. Alternatively, a player may knock down stars 50 and is able to score the stars 50 as long as object 16 actuates the release mechanism 42 of the creature 20 during their last turn. This provides an enhanced game feature as contact with items or stars 50 may cause object 16 to be knocked off its trajectory towards creature or target 20.

In one non-limiting embodiment, the linkage 44 of the release mechanism 42 is further configured to resemble a flapper or tab member that pivots from a first position in a first direction as the object 16 is received within cavity 22. Then the flapper or tab member 44 springs back to the first position in a direction opposite to the first direction which allows the flapper or tab member 44 to be disposed between the object 16 and the cavity 22 opening thus "hiding" the object 16 within cavity 22 further creating the illusion that the creature 20 has eaten the object which resembles a food item.

In various embodiments, game 10 further comprises additional components such as a special character 52, obstacles 54, a clear plastic bubble 56 and a plurality of playing cards 58. In one embodiment, obstacles 54 are configured to be elongated members that define a path of movement from ramp 12 towards object 20.

A non-limiting method of playing game 10 may be as follows, each player has a predetermined amount of turns to use the ramp 12 to hit as many items 50 as possible and trigger the release mechanism 42 of the creature 20.

In one embodiment, each player may have no more than 4 attempts and the first attempt is taken with the ramp 12 at a start position. Thereafter, the next 3 attempts are taken from where the candy or object 16 last stopped. If the object 16 is received within the target 20 on one of the first three turns, that player's turn either ends or that player is allowed to once again release the object 16 from the start position.

Figure 1B:
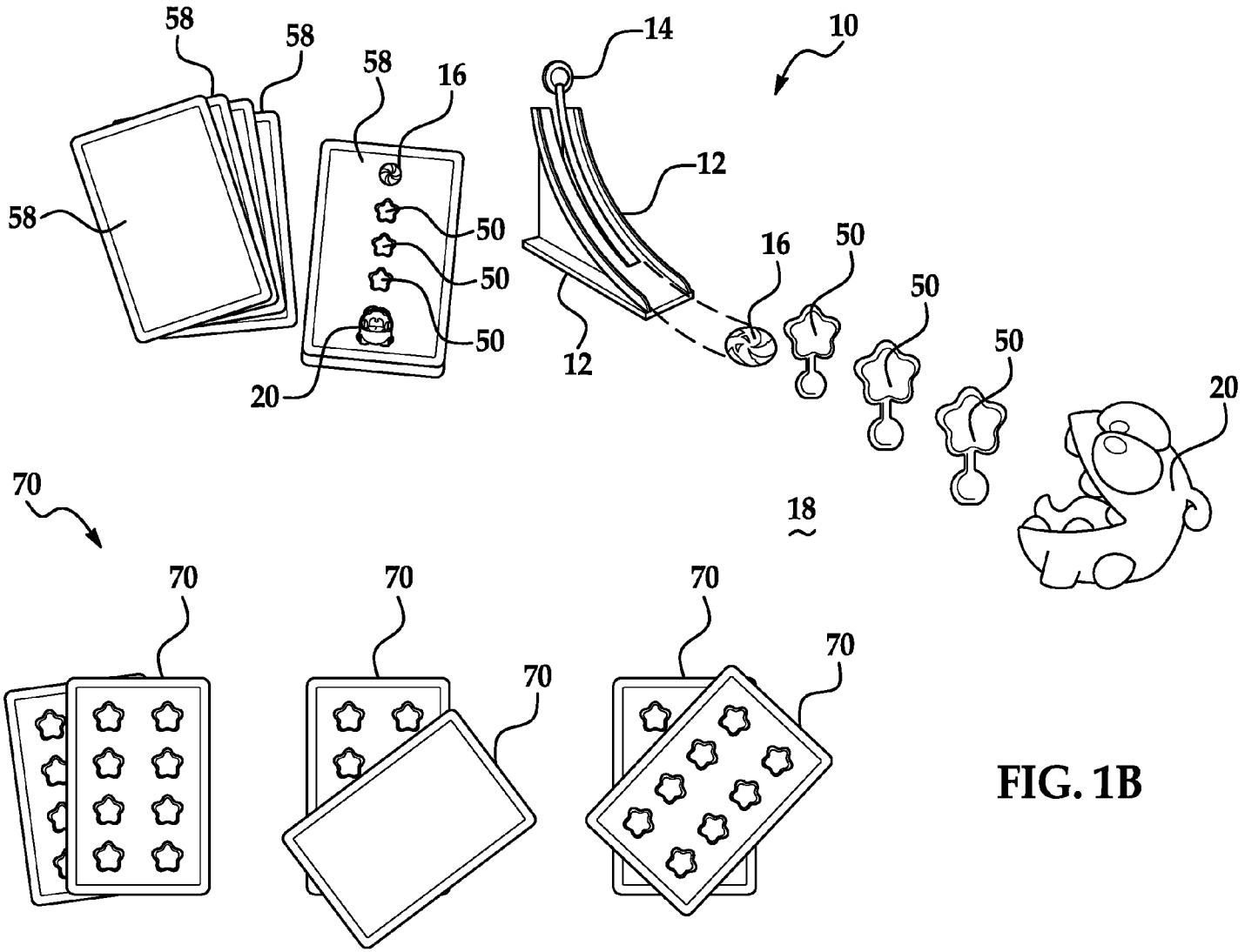

A star or item 50 is considered "hit" if the candy or object 16 knocks it over. If the player is successful in feeding the creature 20 (e.g. actuation of release mechanism 42) then they collect all of the stars 50 that are hit with the object 16. The number of stars 50 hit are recorded with score cards 70 as illustrated in FIG. 1B. FIG. 1B shows examples of scoring of 3 stars and 9 stars. However and in one non-limiting embodiment, if the user does not actuate release mechanism 42 before the end of their turn, they are not allowed to record any stars 50 regardless of how many they knocked down during their turn.

In one embodiment, the player with the most stars at the end of 6 levels is the winner.

As mentioned above, various embodiments contemplate special components such as special character 52, which in one non-limiting embodiment is configured to resemble a spider that may be positioned on surface 18 between the ramp 12 and the creature 20. In this embodiment and when a player is launching object 16 from the ramp 12 and that object contacts the special character 52, they must take a penalty. One non-limiting example of such a penalty is that their remaining attempts (e.g., launches from the ramp 12) are reduced by 1.

Also mentioned above are obstacles 54 which are in one embodiment configured to resemble a row of spikes that can be positioned between ramp 12 and creature 20 on surface 18. In this embodiment and when a player launches the object 16 from the ramp 12 and it contacts one of the obstacles 54 that player's turn is immediately over and they do not get to collect any stars or items 50.

Also mentioned above is a clear plastic bubble 56 which is also positioned on surface 18. When a player launches the object 16 from the ramp 12 and it hits the plastic bubble 56, they may use the bubble 56 to drag the object 16 straight back towards the starting position. In this variation, the player does not have to launch the object 16 from its last location thus providing an advantage to that player. It should be appreciated that the bubble 56 may have any one of numerous configurations.

Still further, a plurality of game cards 58 are also provided. In one non-limiting embodiment, the game cards 58 are used to determine how many items or stars 50 are to be located between ramp 12 and target or creature 20. For example and as illustrated in FIG. 1B, one of the playing cards 58 shows an illustration of three items or stars 50 positioned between object 16 and creature 20 thus, if a player draws this card they must line 3 items 50 between the ramp 12 and the object 20 (see for example FIG. 1B). In one non-limiting embodiment, the cards 58 are used as challenge cards and a player selects one of the challenge cards 58 from the deck and places it face up on the surface 18. In the illustrated embodiment, the displayed card requires that three items 50 be disposed between ramp 12 and object 20. If all three items 50 are knocked over and the object 16 is received within creature 20 that player will collect those three items 50. Alternatively, game 10 can be played with or without cards 58. In other embodiments, the game cards 58 instruct the players as to the items 50, the obstacles 54, any other objects, and their layout or configuration with respect to the ramp 12 and the target or creature 20.

Figure 8:
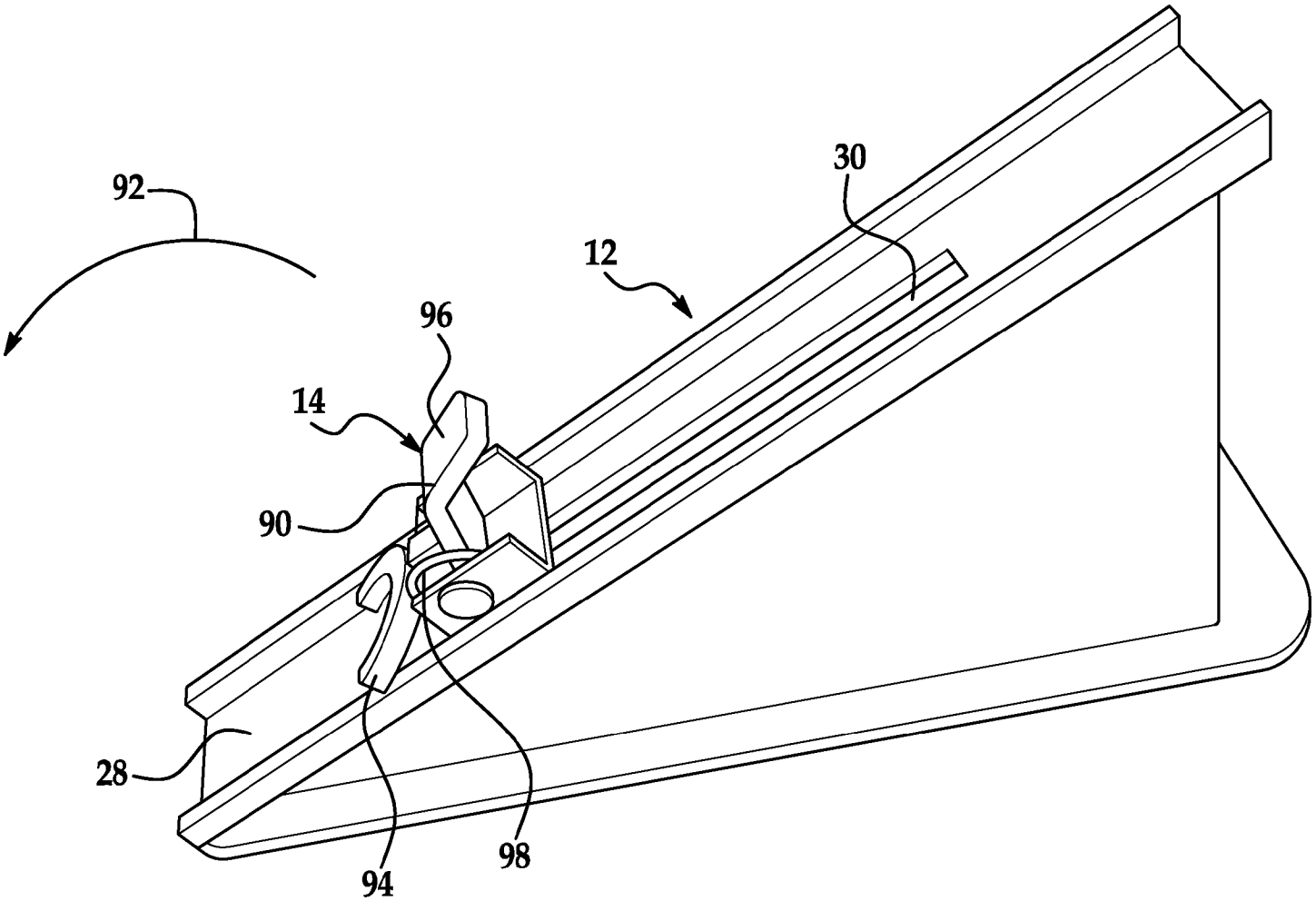
FIG. 8 illustrates a component of an alternative embodiment.

Referring now to FIG. 8 an alternative embodiment of the present invention is illustrated, here ramp 12 is configured to have a release mechanism 14 that slides within an opening 30 of ramp 12 to provide various levels or heights where mechanism 14 can be positioned on ramp 12. In this embodiment, a member 90 of the release mechanism 14 is pivotally mounted thereto and is spring biased downwardly in the direction of arrow 92 into a first position such that a portion 94 of release member 90 will contact an object 16 located below portion 94. In the illustrated embodiment, portion 94 is configured to have a yoke member that will contact object 16 when member 90 is in the first position. In order to release the object 16, a user applies a force to a portion 96 of member 90 in order to overcome the biasing force of spring 98 in the direction of arrow 92 which will cause portion 94 to be elevated from the surface 28 of the ramp 12 and thus release object 16 from portion 94 of member 90. Of course, numerous other types of release mechanism's 14 are considered to be within the scope of exemplary embodiments of the present invention.

Figure 9:
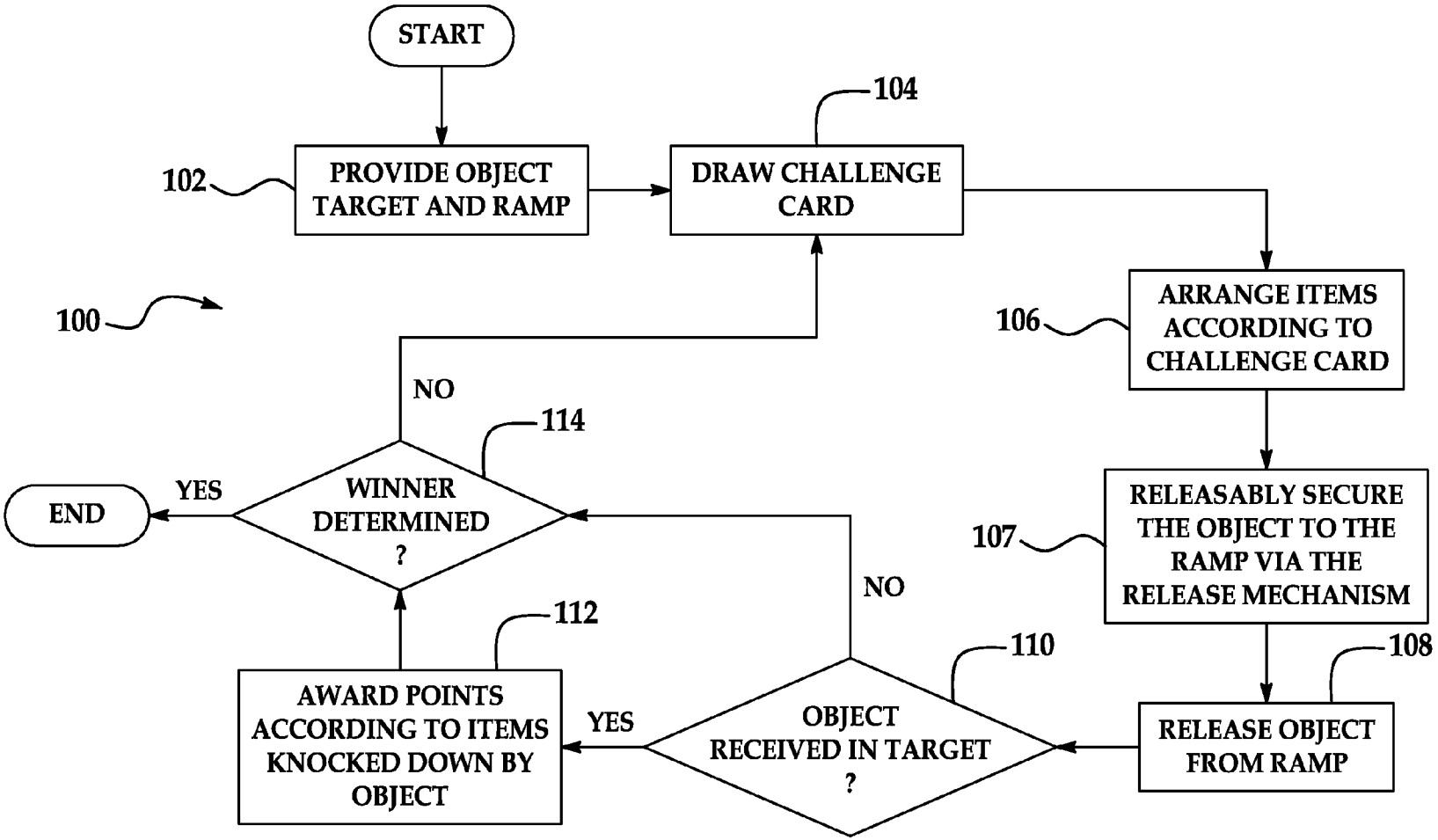
FIG. 9 is a flow chart illustrating an exemplary method of playing the game.

Referring now to FIG. 9, a flowchart 100 illustrating a method of playing a game in accordance with one non-limiting embodiment is provided. Here and at step 102, object 16, target 20 and ramp 12 for releasably securing the object 16 to the ramp 12 via the release mechanism 14 is provided. At step 104, a first player draws a card 58 from the deck and is presented with a challenge wherein the challenge requires a plurality of items 50 to be arranged between the ramp 12 and the target 20. At step 106, the first player arranges the items 50 according to the challenge card 58. At step 107, the object is releasably secured to the ramp 12 via the release mechanism 14. Thereafter and at step 108, the first player releases the object 16 from the ramp 12 via actuation of the release mechanism 14 in an effort to contact or knock over the items 50 with object 16 after it is released from ramp 12. If the object 16 is received within the target 20 (decision node 110) the first player is awarded a predetermined amount of points corresponding to the number of items 50 contacted are knocked over (step 112). If no winner is determined at decision node 114, the next player is provided a turn wherein steps and/or decision nodes 104, 106, 107, 108, 110 and 112 are repeated until a winner of the game is determined.

Accordingly, a game and method of playing a game is disclosed wherein numerous play variations are contemplated to provide unpredictability and action to the game as it is played.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In combination, a ramp and a target, the ramp being configured to launch an object at the target, the ramp comprising:

a release mechanism that is movably mounted to the ramp for movement between a first position and a second position, wherein the release mechanism is configured to retain the object with respect to the ramp when it is in the first position and wherein the release mechanism is configured to release the object when the release mechanism is in the second position; and wherein the target has first member pivotally mounted to a second member for movement between a first target position wherein the first member is further away from the second member and a second target position wherein the first member is closer to the second member, and a target release mechanism configured to retain the first member in the first target position by engaging a portion of the first member and wherein the target release mechanism is configured to release the first member and allow it to travel towards the second target position from the first target position when the target release mechanism of the target has been actuated by the object released from the ramp.

2. The combination of claim 1, wherein the release mechanism of the ramp further comprises an arm member pivotally mounted to the ramp wherein a plurality of features of the arm member protrude from a surface of the ramp when the release mechanism of the ramp is in the first position.

3. The combination of claim 2, wherein the plurality of features are positioned along the arm member in a spaced fashion such that different levels or height of securement of the object with respect to the ramp is provided.

4. The combination of claim 1, wherein a portion of the release mechanism is movably received within a slot of the ramp as the release mechanism of the ramp moves between the first and second position.

5. The combination of claim 4, wherein release mechanism of the ramp is spring biased into the first position.

6. The combination of claim 2, wherein the plurality of features of the arm member are configured to engage an opening located on a lower surface of the object when the release mechanism is in the first position.

7. The combination of claim 1, wherein the target is configured to resemble a creature and the first member and the second member cooperate to define an open mouth of the creature when the first member is in the first target position.

8. The combination of claim 7, wherein the target further comprises a cavity configured for receipt of the object therein and wherein a contact member of the target release mechanism of the target is located within the cavity.

9. The combination of claim 7, wherein the first member of the target is spring biased into the first position.

10. The combination of claim 1, wherein the object is slidably propelled downwardly along a surface of the ramp when the release mechanism is moved from the first position to the second position.

11. A ramp for launching an object at a target, comprising:

a release mechanism mounted to the ramp for movement between a first position and a second position, wherein the release mechanism is configured to retain the object with respect to the ramp when it is in the first position and wherein the release mechanism is configured to release the object when the release mechanism is in the second position; and wherein the release mechanism further comprises an arm member pivotally mounted to the ramp and the arm member has a plurality of features each spaced from each other and extending from the arm member and protruding through a surface of the ramp when the release mechanism is in the first position.

12. The ramp as in claim 11, wherein the plurality of features of the arm member are positioned along the arm member in a spaced fashion such that different levels or height of securement of the object with respect to the ramp is provided.

13. The ramp as in claim 11, wherein a portion of the arm member is movably received within a slot of the ramp as the release mechanism of the ramp moves between the first and second position.

14. The ramp as in claim 13, wherein the release mechanism of the ramp is spring biased into the first position.

15. A ramp for launching an object at a target, comprising:

a release mechanism mounted to the ramp for movement between a first position and a second position, wherein the release mechanism is configured to retain the object with respect to the ramp when it is in the first position and wherein the release mechanism is configured to release the object when the release mechanism is in the second position; and wherein the release mechanism further comprises an arm member pivotally mounted to the ramp and the arm member has a plurality of features each spaced from each other and extending from the arm member above a surface of the ramp when the release mechanism is in the first position, wherein the plurality of features of the arm member are positioned along the arm member in a spaced fashion such that different levels or height of securement of the object with respect to the ramp is provided, and wherein each of the plurality of features of the arm member are configured to engage an opening located on a lower surface of the object when the release mechanism is in the first position.

16. A method of playing a game, comprising:

releasably securing an object with respect to a ramp via a release mechanism that is movably mounted to the ramp for movement between a first position and a second position, wherein the release mechanism is configured to retain the object with respect to the ramp when it is in the first position and wherein the release mechanism is configured to release the object when the release mechanism is in the second position;

launching the object at a target by moving the releasable mechanism of the ramp to the second position;

awarding a player a score if the player launches the object into a cavity of a target such that a first member pivotally mounted to a second member of the target moves from a first target position wherein the first member is further away from the second member to second target position wherein the first member is closer to the second member, wherein the first member of the target is retained in first target position by a target release mechanism and wherein the target release mechanism is configured to release the first member from the first target position and allow it to travel towards the second target position from the first target position when the target release mechanism of the target has been actuated by the object received in the cavity of the target; and determining a winner of the game by determining which player after a predetermined amount of turns has accumulated the greatest score.

17. The method as in claim 16, wherein the release mechanism of the ramp further comprises an arm member pivotally mounted to the ramp wherein a plurality of features of the arm member protrude from a surface of the ramp when the release mechanism of the ramp is in the first position.

18. The method as in claim 17, wherein the plurality of features are positioned along the arm member in a spaced fashion such that different levels or height of securement of the object with respect to the ramp is provided.

19. The method as in claim 17, wherein a portion of the arm member is movably received within a slot of the ramp as the release mechanism of the ramp moves between the first and second position.

20. The method as in claim 17, wherein the target is configured to resemble a creature and the first member and the second member cooperate to define an open mouth of the creature when the first member is in the first target position.

* * * * *